US011573536B2

(12) United States Patent
Matsue et al.

(10) Patent No.: US 11,573,536 B2
(45) Date of Patent: Feb. 7, 2023

(54) ANTENNA RECEIVING APPARATUS AND ELECTRONIC WATCH

(71) Applicant: CASIO COMPUTER CO., LTD., Tokyo (JP)

(72) Inventors: Takeshi Matsue, Kokubunji (JP); Munetaka Seo, Fussa (JP); Hiroshi Katsuda, Kodaira (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 71 days.

(21) Appl. No.: 17/330,674

(22) Filed: May 26, 2021

(65) Prior Publication Data

US 2021/0373507 A1 Dec. 2, 2021

(30) Foreign Application Priority Data

May 28, 2020 (JP) ..... JP2020-092797

(51) Int. Cl.

| | |
|---|---|
| ***H01Q 9/30*** | (2006.01) |
| ***G04G 21/04*** | (2013.01) |
| ***H01Q 1/27*** | (2006.01) |
| ***H01Q 21/28*** | (2006.01) |

(52) U.S. Cl.

CPC ..... *G04G 21/04* (2013.01); *H01Q 1/273* (2013.01); *H01Q 9/30* (2013.01); *H01Q 21/28* (2013.01)

(58) Field of Classification Search

CPC ..... H01Q 21/28; H01Q 9/30; H01Q 1/273

See application file for complete search history.

(56) References Cited

FOREIGN PATENT DOCUMENTS

| | | | |
|---|---|---|---|
| JP | 2013040793 | A | 2/2013 |
| JP | 2015172544 | A | 10/2015 |
| JP | 2017044555 | A | 3/2017 |
| JP | 2017161338 | A | 9/2017 |
| JP | 2019-124641 | A | 7/2019 |
| JP | 2019211333 | A | 12/2019 |

OTHER PUBLICATIONS

Notice of Reasons for Refusal dated Jul. 5, 2022 received in Japanese Patent Application No. JP 2020-092797.

*Primary Examiner* — Graham P Smith

(74) *Attorney, Agent, or Firm* — Scully Scott Murphy & Presser

(57) ABSTRACT

An antenna receiving apparatus includes, a first antenna; a second antenna that is synchronized with a frequency band different from the first antenna; a substrate that includes a receiving circuit connected to each of the first antenna and the second antenna; and a back lid that includes a conductor, wherein the conductor is in at least a portion of the back lid. The substrate includes a grounding surface of the first antenna. The substrate and the second antenna are positioned between the first antenna and the back lid. The second antenna is positioned on a side of the substrate opposite of the first antenna, and the second antenna is electrically connected to the conductor of the back lid and grounded.

18 Claims, 4 Drawing Sheets

ANTENNA RECEIVING APPARATUS AND ELECTRONIC WATCH

CROSS-REFERENCE TO RELATED APPLICATION

This application is based upon and claims the benefit of priority under 35 USC 119 of Japanese Patent Application No. 2020-092797, filed on May 28, 2020, the entire disclosure of which, including the description, claims, drawings, and abstract, is incorporated herein by reference in its entirety.

BACKGROUND

1. Field of the Invention

The present disclosure relates to an antenna receiving apparatus and an electronic watch.

2. Description of the Related Art

In most electronic devices that perform wireless communication, and especially in small portable electronic devices, an antenna is provided inside a case. JP 2019-124641 describes when radio waves with a plurality of wavelengths are received, a plurality of antennas may be provided according to each wavelength.

BRIEF SUMMARY OF THE INVENTION

According to one aspect of the present invention, an antenna receiving apparatus includes: a first antenna; a second antenna that is synchronized with a frequency band different from the first antenna; a substrate that includes a receiving circuit connected to each of the first antenna and the second antenna; and a back lid that includes a conductor, wherein the conductor is in at least a portion of the back lid, wherein, the substrate includes a grounding surface of the first antenna, the substrate and the second antenna are positioned between the first antenna and the back lid, and the second antenna is positioned on a side of the substrate opposite of the first antenna, and the second antenna is electrically connected to the conductor of the back lid and grounded.

According to another aspect, an electronic watch includes, the above antenna receiving apparatus, a timekeeper that counts present time; and a controller which corrects the present time counted by the timekeeper based on the radio wave received by at least the first antenna and/or the second antenna.

DETAILED DESCRIPTION OF THE INVENTION

Embodiments of the present invention are described with reference to the drawings.

Figure 1:
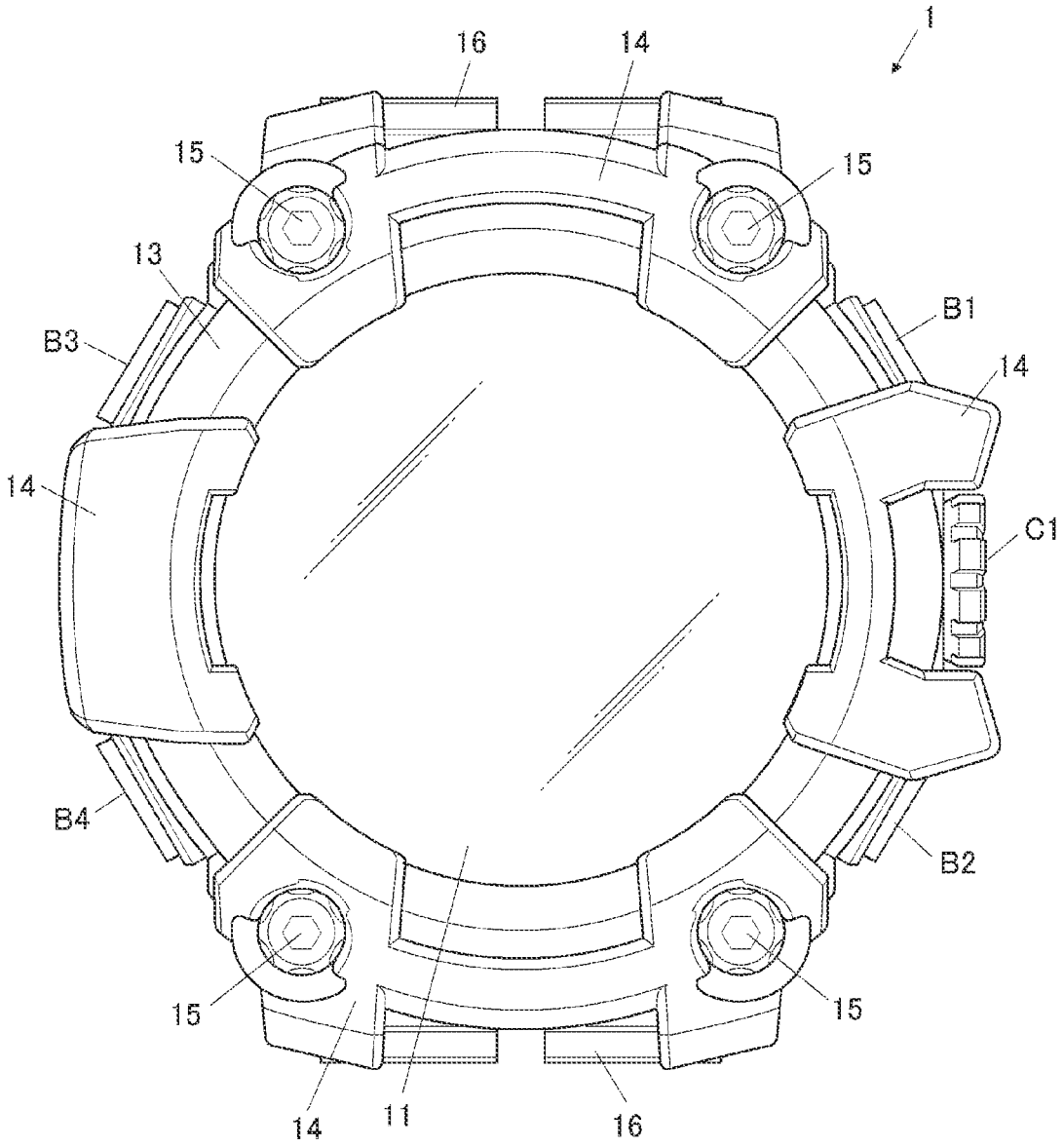
FIG. 1 is a plan view showing an exterior appearance of an electronic watch.

FIG. 1 is a plan view showing an exterior appearance of an electronic watch 1 including an antenna receiving apparatus according to the present embodiment.

The electronic watch 1 includes a display 11, a case 12 (see FIG. 2), a bezel 13, an exterior member 14 which covers a portion of the bezel 13, a screw 15, and a connector 16 which connects a belt to a main body. An upper surface of the electronic watch 1 includes the display 11 at a center and the bezel 13 in a position surrounding the display 11. Press button switches B1 to B4 and a crown C1 are provided on a side of the electronic watch 1. The exterior member 14 is fixed to a case 12 by a screw 15 (see FIG. 2). With this, the bezel 13 is fixed between the exterior member 14 and the case 12.

The exterior member 14 includes the function to protect the main body of the electronic watch 1 including the press button switches B1 to B4 and the crown C1 by the uneven surface and also includes the function as a decorative design. Material for the exterior member 14 may be, for example, resin.

The bezel 13 is a conducting member (normally a metal member) including a ring shaped structure. The bezel 13 operates as a first antenna in the electronic watch 1. Here, the first antenna receives a radio wave (right handed circular polarization wave) from a positioning satellite (mainly a satellite regarding GPS (Global Positioning Satellite System)).

The press button switches B1 to B4 and the crown C1 penetrate through the side of the case 12 and are projected outward. With this, the operation of pressing the press button switches B1 to B4 and the operation of pulling out and rotating the crown C1 can be received.

The display 11 includes a digital display, and displays digitally.

Figure 2:
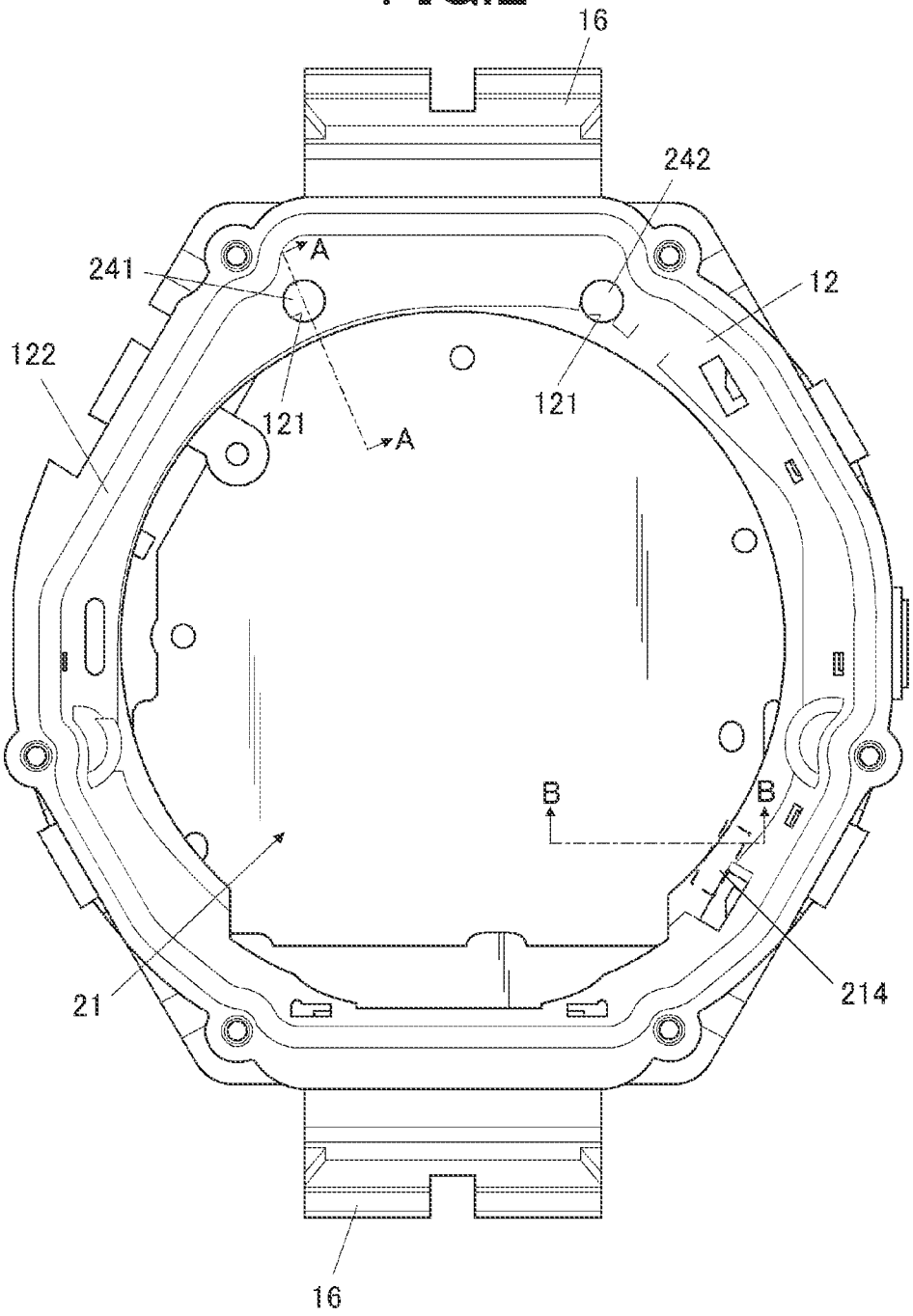
FIG. 2 describes a relation of positions of antennas.

FIG. 2 is a diagram describing the relation of the positions of the antennas. Similar to FIG. 1, this diagram is a plan view viewed from above.

Although not limited, the case 12 includes a structure with a tube shape such as a cylinder shape. The case 12 includes an operation module such as a substrate 21 and a battery 30 (see FIG. 3) inside the tube and protects the units inside. Through holes for the above-described press button switches B1 to B4 and the crown C are provided on the side of the case 12.

Two through holes 121 extending in a direction along the planar view direction (up and down direction) are positioned near a one o'clock direction and an eleven o'clock direction of the case 12. Connecting pins 241 and 242 are inserted in these through holes 121. The connecting pins 241 and 242 each electrically connect the bezel 13 as the antenna and the area on the substrate 21. The connecting pins 241 and 242 do not need to be joined (fixed) to the case 12 or other portions. One end of the connecting pin 241 in contact with the bezel 13 is to be a feeding point and the other end transmits a receiving signal to a receiving circuit (here, a receiving circuit may include a circuit which only receives or a circuit which transmits and receives) connected through a signal line. The connecting pin 242 is connected to a grounding surface on the substrate 21.

The case 12 includes an inserting groove 122 for an O ring on an outer side than the through holes 121. The bezel 13 and the exterior member 14 are in contact and fixed in a state with the O ring inserted. With this, the structure becomes a waterproof structure.

An antenna element 214 (second antenna) is positioned near a four o'clock direction on a back side of the substrate 21, that is, on a side of the substrate 21 opposite to the bezel 13. The antenna element 214 is an antenna which performs wireless radio communication with external devices at a close distance, here, communication (transmitting and receiving radio waves) by Bluetooth (registered trademark). That is, the antenna element 214 is an antenna which synchronizes with a frequency band different from the bezel 13. Here, the antenna element 214 is a monopole antenna but is not limited to a straight line shape, and may have a bent shape (meander). The antenna element 214 is electrically connected to an area on the substrate 21 with a communicating circuit 213 (see FIG. 3) positioned near the antenna element 214. As described later, the antenna 214 is electrically connected and grounded from the grounding terminal on the substrate 21 to a back lid 17 (see FIG. 3B).

Figure 3A:
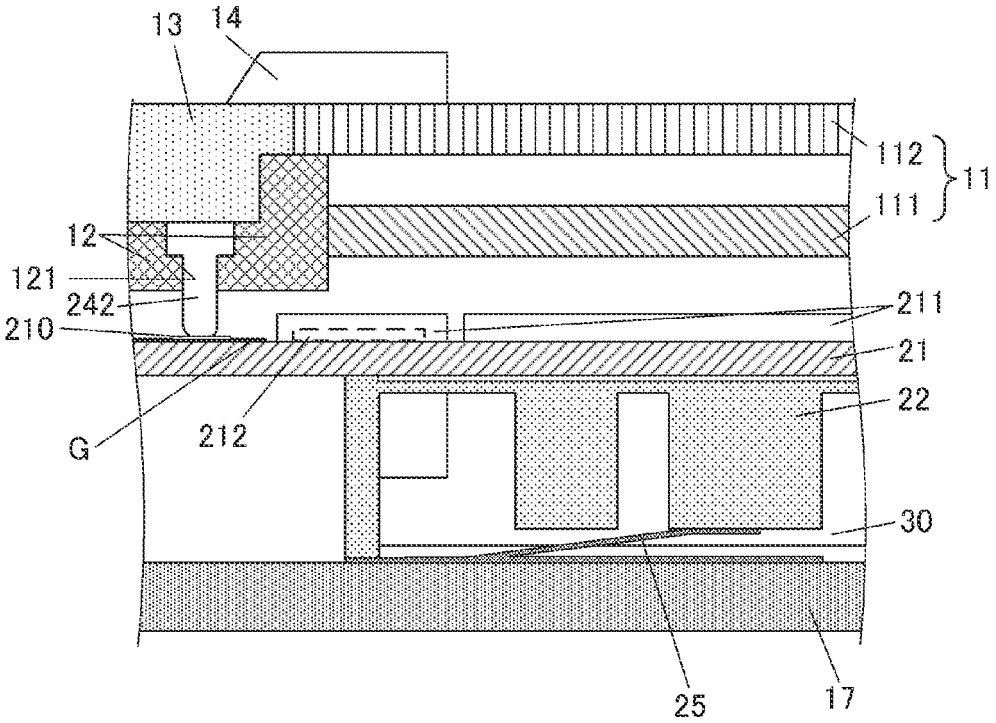
FIG. 3A shows a portion of a cross-section of the electronic watch.
Figure 3B:
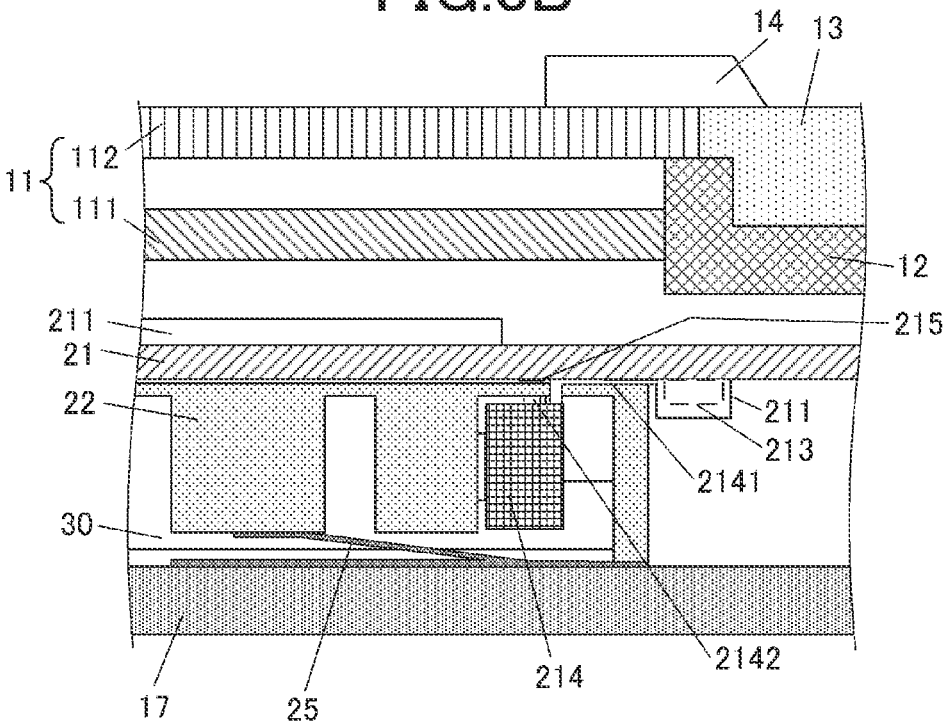
FIG. 3B shows a portion of a cross-section of the electronic watch.
Figure 4:
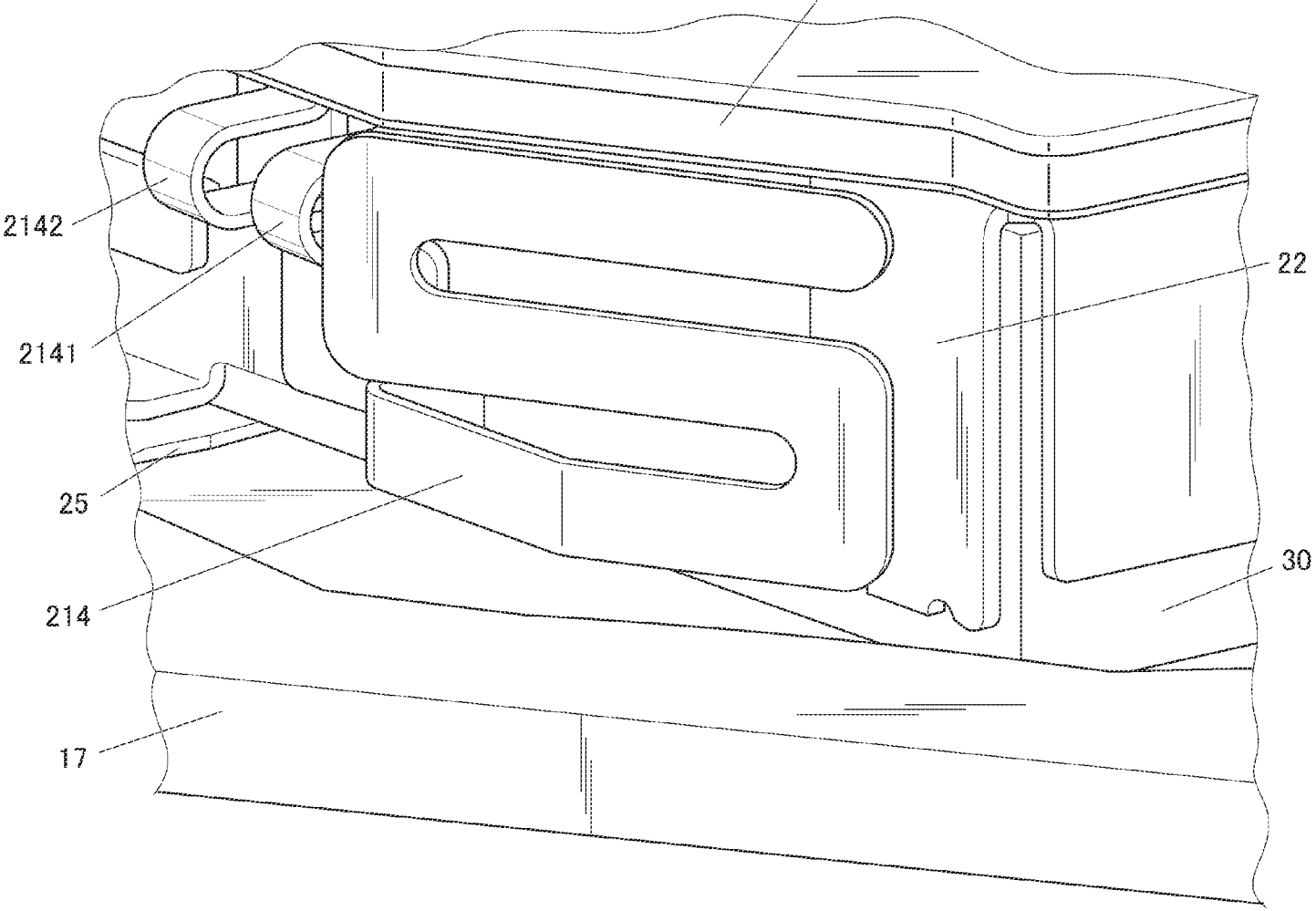
FIG. 4 shows an antenna element.

FIG. 3A is a diagram showing a portion of a cross-section including the connecting pin 242 of the electronic watch 1 and FIG. 3B is a diagram showing a portion of a cross-section including the antenna element 214. That is, the cross-section shown in FIG. 3A is the portion shown with a cross-section line AA in FIG. 2, and the cross-section shown in FIG. 3B is the portion shown with a cross-section line BB in FIG. 2. FIG. 4 is a diagram showing the antenna element 214.

A display screen 111 and an optically transparent (normally transparent) protecting layer 112 (contact glass) which covers the display screen are positioned on the upper side of the substrate 21. The protecting layer 112 covers the upper edge surface of the case 12. A frame 22 (conducting supporter, storage) and a battery 30 which is fixed or supported by the frame 22 are positioned on the lower side of the substrate 21. The lower edge surface of the case 12 is covered by the back lid 17. The entire back lid 17 is a conducting member, but if a portion suitable as a grounding surface is a conductor, the remaining portion may be an insulator.

Some of the circuits on the substrate 21, for example, a communicating circuit regarding the transmitting and receiving of the radio wave and the CPU which operates as a controller and performs control operations such as counting, displaying and correcting the date and time are covered by a shield case 211. A shield case 211, etc. protects the elements inside from electromagnetic waves and static electricity, and is a conductor with a box-type structure, for example. The other structures on the substrate 21, for example, oscillating circuit, time keeper which counts the present date and time (present time) and nonvolatile memory can be positioned outside the shield case 211, etc.

As shown in FIG. 3A, a satellite radio wave receiving module 212 including a receiver which receives the radio wave from the positioning satellite and a processor which processes the received radio wave is positioned in the shield case 211 near the connecting pins 241 and 242 on the upper surface side of the substrate. The satellite radio wave receiving module 212 performs a process in which the radio wave received by the receiver is demodulated by the processor and the signal is decoded by the processor so that the present date and time and the present position are specified. The controller on the substrate 21 may correct the date and time counted by the timekeeper based on the specified present date/time.

For example, the display screen 111 is a liquid crystal display screen, but the present embodiment is not limited to the above, and any type of liquid crystal may be used. Various displays are shown on the display screen 111 based on a control signal from the controller on the substrate 21.

The connecting pin 242 is electrically connected to the grounding terminal 210 on the substrate 21, and is connected to the grounding surface G spreading on the substrate 21 (here, the grounding surface G is displayed only near the connecting portion with the grounding terminal 210). When the substrate 21 is a layered substrate, the grounding surface may spread in an intermediate layer which is not exposed. Here, the grounding terminal 210 and the grounding surface G are clearly shown for the ease of description, but the actual thickness of the grounding terminal 210 and the grounding surface G may be sufficiently thin compared to the thickness of the substrate 21.

The connecting pin 24 inserted in the through hole 121 of the case 12 includes a spring structure capable of expanding and contracting in an extending direction. When the electronic watch 1 is assembled and sealed, one end of the connecting pin 242 comes into contact with the substrate 21 and the other end comes into contact with the bezel 13 in a state in which the spring is contracted. With this, even if some impact is applied to the electronic watch 1, the contact to both sides is maintained by tension of the spring. There are two widths in the through hole 121, and the connecting pin 24 includes a head shape to fit in the two widths. With this, it is possible to prevent shift in the position in the left and right direction.

As described above, the bezel 13 connected to the connecting pin 24 in two positions is positioned in a surface parallel to the grounding surface G on the substrate 21 to which the bezel 13 is connected. The bezel 13 is paired with the grounding surface G and with this, operates as a microstrip antenna.

As shown in FIG. 3B, the shield case 211 is provided on the bottom side of the substrate 21, and the communicating circuit 213 regarding Bluetooth is positioned in the shield case 211.

At least a portion of the frame 22 is a conducting member. The frame 22 stores, holds, and protects the battery 30 in a space inside. The frame 22 comes into contact with the grounding surface G of the substrate 21 and the back lid 17 (conducting portion) and spreads the range of the conducting surface to the back lid 17. The frame 22 does not have to cover the entire side of the battery 30, but the portions extending in the up and down direction include a plate shape or a pillar shape structure, and include a sufficiently large conducting surface area compared to wires on the substrate 21. A plate spring 25 which is a conducting member (metal, etc.) may be positioned between the frame 22 and the back lid 17 and the frame 22 and the back lid 17 may be connected through the plate spring 25 so that the connection is more electrically stable and the resistance is low (low impedance).

The battery 30 is connected to an electric supply terminal of the substrate 21 and supplies electric power to the circuits of the substrate 21. The battery 30 may be detachable and exchangeable or may be fixed to the frame 22. In the latter situation, the battery 30 may be rechargeable by power generated by a solar panel (not shown) or the battery 30 may be connected to an external connecting terminal and the battery may be rechargeable by power supplied from outside.

As shown in FIG. 3B and FIG. 4, an antenna element 214 is attached to the side of the frame 22. As described above, the antenna element 214 is an antenna to transmit and receive a communicating radio wave when communication is performed by Bluetooth (here, monopole antenna bent in an S-shape), and the synchronizing frequency (receiving frequency) is different from the bezel 13. The antenna element 214 transmits the receiving signal to the communicating circuit 213 on the substrate 21 through wires 2141, and transmits the signal regarding the transmitted contents obtained from the communicating circuit 213. The communicating circuit 213 may obtain the present date/time information from outside by Bluetooth. The controller may correct the date/time of the timekeeper based on the obtained date/time information.

The antenna element 214 is connected to the grounding terminal 215 on the back surface of the substrate 21 through wires 2142. The grounding surface (not shown) including the grounding terminal 215 is connected to the conducting portion of the frame 22 in the nearby area (sufficiently short compared to the length of the monopole antenna such as within the range of the distance equal to or less than ½ of ¼ wavelength or equal to or less than ¼). As described above, the frame 22 is electrically connected to the back lid 17 through the plate spring 25. The grounding surface G connected to the bezel 13 (connecting terminal 210) and the connecting surface connected to the antenna element 214 (grounding terminal 215) may be connected or may be separated from each other.

As described above, the antenna element 214 and the substrate 21 are positioned in the space inside the case 12 between the bezel 13 and the back lid 17. According to such configuration, an electric field component projected on the grounding surface of the antenna element 214 which is the monopole antenna spreads mainly from the frame 22 to the back lid 17. Therefore, the potential of the grounding surface G on the substrate 21 is not greatly disturbed from the grounding potential. With this, the grounding surface G on the substrate 21 by the bezel 13 functions suitably and the radio wave from the positioning satellite can be received with good sensitivity.

Among the above structures, the bezel 13, the antenna element 214, the substrate 21 including the satellite radio wave receiving module 212, the communicating circuit, and the grounding surface G and the back lid 17 are included in the antenna receiving apparatus according to the present embodiment.

According to the present embodiment, the antenna receiving apparatus according to the present embodiment includes a bezel 13 as a first antenna, an antenna element 214 which synchronizes with a frequency band different from the bezel 13, a substrate 21 including a receiving circuit (satellite radio wave receiving module 212 and communicating circuit 213) to which the bezel 13 and the antenna element 214 are connected, and a back lid 17 that includes a conductor, wherein the conductor is in at least a portion of the back lid. The substrate 21 includes a grounding surface G of the bezel 13. The substrate 21 and the antenna element 214 are positioned between the bezel 13 and the back lid 17. The antenna element 214 is positioned on the side of the substrate 21 opposite to the bezel 13, and is electrically connected to the conducting portion of the back lid 17 and grounded.

As described above, by separating the grounding surface according to the operations of the plurality of antennas, the bad influence on another operation by one electric field pattern on the grounding surface caused in one operation can be reduced. By dividing the groups including the antenna and the grounding surface to the front surface side and the back surface side, the radio wave receiving accuracy of each group is not reduced. Therefore, communication operations by a plurality of antennas can be performed suitably in parallel in the antenna receiving apparatus. That is, according to JP 2019-124641, the monopole antenna and the path antenna which are stored in the case and often used when transmitting and receiving wireless radio waves such as those in the GHz band need a grounding surface. When the case grounding surface in the antenna receiving apparatus is a large range in the antenna receiving apparatus, if the operation of a plurality of antennas are performed together, the electric field pattern occurring on the grounding surface according to one antenna operation may have a bad influence on the reception of the radio wave by another antenna. According to the present embodiment, it is possible to perform the receiving operation by a plurality of antennas suitably in parallel.

Specifically, by performing the grounding to the back lid 17 of the antenna element 214 through the grounding surface of the substrate 21, the difficulty of manufacturing can be decreased. In a portable antenna receiving apparatus, it is often assumed that a large impact is provided when carried, but it is difficult from limitations in the manufacturing process and structure to directly connect the antenna element 214 to the back lid 17 strongly to be prepared for impact. On the other hand, it is relatively easy to connect the grounding surface of the substrate 21 with a large size in the antenna apparatus to the back lid 17. It is easily possible to make it difficult for the contact between the substrate 21 and the back lid 17 to become completely off even if a large impact is applied to the antenna receiving apparatus. Therefore, the antenna receiving apparatus in which the back lid 17 is grounded through the grounding surface of the substrate 21 can be easily manufactured, and it is possible to stably perform reception of radio waves in a plurality of frequencies in parallel.

The antenna element 214 is connected to the side of the substrate 21 opposite of the bezel 13. The antenna element 214 positioned on the back side of the substrate 21 is directly connected to the back side of the substrate 21. With this, the lines can be made easy and short, and the influence of parasitic resistance and parasitic capacitance in the middle can be reduced.

The antenna receiving apparatus (electronic watch 1) includes a frame 22 positioned between the substrate 21 and the back lid 17. The antenna element 214 is electrically connected to the conductor portion of the back lid 17 through the frame 22. The supporting member such as the frame 22 includes a width and thickness larger than the wires. Therefore, the frame 22 itself may also be the grounding surface. Therefore, it is possible to increase the grounding area near the antenna element 214, and the portion which is to be the grounding surface of the antenna element 214 can be separated from the portion which is to be the grounding surface G of the bezel 13. Therefore, suitable reception can be performed.

The frame 22 is storage including a space where the battery 30 is positioned inside. In a small portable device such as an electronic watch, the volume that the battery 30 occupies is large, and the frame 22 according to the above is also large. Therefore, it is possible to enlarge the grounding area by effectively using the conventional structure. Moreover, the frame 22 can be connected to the back lid 17 with low resistance, and the frame 22 hardly causes the reception sensitivity of the antenna element 214 to become low.

The bezel 13 is a ring shape and is positioned in a surface parallel to the substrate 21. According to such position, when a display in the center, specifically a round display as in a wrist watch is included, it is possible to suitably perform wireless communication without interfering with the display.

The antenna element 214 is a monopole antenna. In the monopole antenna, since ¼ of a wavelength appears on the grounding surface as a reflected image, the influence of the grounding surface in a limited area is large. In this case, by separating the grounding surface from the substrate 21 to the back lid 17, it is possible to reduce the influence of the bezel 13 to the radio wave reception.

The bezel 13 receives the radio wave from the positioning satellite, and the antenna element 214 receives the radio wave regarding the wireless radio wave communication by Bluetooth with external devices. The radio waves with two wavelengths often used in recent portable electronic devices can be suitably received at the same time. Therefore, the convenience of the portable electronic device may be enhanced.

The electronic watch 1 according to the present embodiment includes an antenna receiving apparatus, a time keeper which counts present time, and a controller which corrects the present time counted by the time keeper based on the radio wave received by at least the bezel 13 and/or the antenna element 214. According to such electronic watch 1, it is possible to transmit and receive the radio waves with two types of wavelengths in parallel without increasing the size of the watch. Therefore, the function of the electronic watch 1 can be enhanced.

The present invention is not limited to the above-described embodiments, and various modifications are possible.

For example, according to the present embodiment, the bezel 13 as the first antenna is described to be a ring shape to match with the structure of the electronic watch 1 but the shape is not limited to the above. If there is no problem in positioning, antennas with other shapes such as a plane antenna is possible. Alternatively, the antenna element 214 is described as the monopole antenna, but the antenna element 214 may function as the pair to the back lid and may be a patch antenna which receives the radio wave. Even if the device is the electronic watch, the first antenna does not have to be a bezel.

According to the above embodiment, the bezel 13 on the upper surface side of the substrate 21 receives the radio wave from the positioning satellite, and the antenna element 214 on the lower surface side of the substrate 21 is the antenna which performs communication by Bluetooth, but the combination is not limited to the above. The transmitting and receiving of other radio waves are possible as long as the antenna can be positioned in the suitable shape and the suitable relation in each position. For example, the antenna element 214 may transmit and receive the communication radio waves regarding wireless LAN.

The communicating circuit 213 connected to the antenna element 214 does not have to be positioned on the lower surface side of the substrate 21. In this case, the lines 2141 may include a penetrating via or a through hole penetrating the substrate 21.

The frame 22 according to the present embodiment does not have to be used to store the battery 30. The frame 22 may support the substrate 21 or may store inside another structure such as a structure to drive the moveable portions such as the hands. The battery 30 may include various structures to obtain electric power by generating power by sunlight or oscillating in addition to the portion accumulating charge.

According to the present embodiment, the electronic watch 1 which is worn on the arm includes the antenna receiving apparatus, but the antenna receiving apparatus may be used in an electronic device other than a watch. For example, other electronic devices include an activity monitor or various measuring devices (sensors). Such electronic devices may include a timekeeping function. The electronic watch 1 may include various functions other than the timekeeping function.

Other than the above, the specific configuration, shape, structure, relation of positions, contents and procedures of the processes shown in the above embodiments can be suitably modified without leaving the scope of the present invention.

Although various embodiments have been shown and described, the scope of the present invention is not limited by the above-described embodiments, and the scope of the present invention includes the scope as described in the attached claims and its equivalents.

What is claimed is:

1. An antenna receiving apparatus comprising:
a first antenna;
a second antenna that is synchronized with a frequency band different from the first antenna;
a substrate that includes a receiving circuit connected to each of the first antenna and the second antenna; and
a back lid that includes a conductor, wherein the conductor is in at least a portion of the back lid,
wherein,
the substrate includes a grounding surface of the first antenna,
the substrate and the second antenna are positioned between the first antenna and the back lid, and
the second antenna is positioned on a side of the substrate opposite of the first antenna, and the second antenna is electrically connected to the conductor of the back lid and grounded.

2. The antenna receiving apparatus according to claim 1, wherein the second antenna is connected to a surface of the substrate on a side opposite of the first antenna.

3. The antenna receiving apparatus according to claim 1, further comprising a conductor supporter positioned between the substrate and the back lid,
wherein, the second antenna is electrically connected to the conductor of the back lid through the conductor supporter.

4. The antenna receiving apparatus according to claim 2, further comprising a conductor supporter positioned between the substrate and the back lid,
wherein, the second antenna is electrically connected to the conductor of the back lid through the conductor supporter.

5. The antenna receiving apparatus according to claim 3, wherein the conductor supporter is a storage that includes a space in which a battery is positioned inside.

6. The antenna receiving apparatus according to claim 4, wherein the conductor supporter is a storage that includes a space in which a battery is positioned inside.

7. The antenna receiving apparatus according to claim 1, wherein the first antenna is a ring shape and is positioned on a surface parallel to the substrate.

8. The antenna receiving apparatus according to claim 1, wherein the second antenna is a monopole antenna.

9. The antenna receiving apparatus according to claim 1, wherein the first antenna receives a radio wave from a positioning satellite and the second antenna receives a radio wave regarding wireless radio wave communication with external devices in a close distance.

10. An electronic watch comprising:
an antenna receiving apparatus according to claim 1,
a timekeeper that counts present time; and a controller which corrects the present time counted by the timekeeper based on a radio wave received by at least a first antenna and/or a second antenna.

11. An electronic watch comprising:

an antenna receiving apparatus according to claim 2, a timekeeper that counts present time; and a controller which corrects the present time counted by the timekeeper based on a radio wave received by at least a first antenna and/or a second antenna.

12. An electronic watch comprising:

an antenna receiving apparatus according to claim 3, a timekeeper that counts present time; and a controller which corrects the present time counted by the timekeeper based on a radio wave received by at least a first antenna and/or a second antenna.

13. An electronic watch comprising:

an antenna receiving apparatus according to claim 4, a timekeeper that counts present time; and a controller which corrects the present time counted by the timekeeper based on a radio wave received by at least a first antenna and/or a second antenna.

14. An electronic watch comprising:

an antenna receiving apparatus according to claim 5, a timekeeper that counts present time; and a controller which corrects the present time counted by the timekeeper based on a radio wave received by at least a first antenna and/or a second antenna.

15. An electronic watch comprising:

an antenna receiving apparatus according to claim 6, a timekeeper that counts present time; and a controller which corrects the present time counted by the timekeeper based on a radio wave received by at least a first antenna and/or a second antenna.

16. An electronic watch comprising:

an antenna receiving apparatus according to claim 7, a timekeeper that counts present time; and a controller which corrects the present time counted by the timekeeper based on a radio wave received by at least a first antenna and/or a second antenna.

17. An electronic watch comprising:

an antenna receiving apparatus according to claim 8, a timekeeper that counts present time; and a controller which corrects the present time counted by the timekeeper based on a radio wave received by at least a first antenna and/or a second antenna.

18. An electronic watch comprising:

an antenna receiving apparatus according to claim 9, a timekeeper that counts present time; and a controller which corrects the present time counted by the timekeeper based on a radio wave received by at least a first antenna and/or a second antenna.

* * * * *